US006360578B1

(12) United States Patent
Bresnahan

(10) Patent No.: US 6,360,578 B1
(45) Date of Patent: Mar. 26, 2002

(54) TOOL FOR RESTORING ROUNDNESS TO PIPE COUPLINGS

(76) Inventor: Jeremiah J. Bresnahan, 5741 College, St. Louis, MO (US) 63136

( * ) Notice: Subject to any disclaimer, the term of this patent is extended or adjusted under 35 U.S.C. 154(b) by 0 days.

(21) Appl. No.: 09/635,383

(22) Filed: Aug. 9, 2000

(51) Int. Cl.[7] ..... B21D 31/00; B25F 1/00

(52) U.S. Cl. ..... 72/477; 7/125; 7/157; 7/138; 7/158

(58) Field of Search ..... 7/157, 169, 170, 7/158, 128, 139, 125, 127; 72/477, 479, 457; 408/211, 227

(56) References Cited

U.S. PATENT DOCUMENTS

| | | | | |
|---|---|---|---|---|
| 2,196,701 A | 4/1940 | Homsher | | |
| 2,575,779 A | 11/1951 | Young | 7/14.1 | |
| 2,637,227 A | 5/1953 | McIntosh | | |
| 2,838,773 A | 6/1958 | Muse | 7/14.1 | |
| 3,921,237 A | 11/1975 | Steiner | 7/5.4 | |
| 4,016,614 A | 4/1977 | Press | 7/14.1 R | |
| 4,076,446 A | 2/1978 | Lindstaedt | 408/227 | |
| 4,720,219 A | 1/1988 | Masonek et al. | 408/201 | |

*Primary Examiner*—D. S. Meislin
(74) *Attorney, Agent, or Firm*—Grace J. Fishel

(57) ABSTRACT

A hand tool for restoring roundness to an open end of a pipe coupling formed of copper or the like. The tool has a series of sections of non-concentric grooves of increasing diameters separated by ridges over which the open end of the coupling is slipped. The ridge bordering the inside of the groove serving as a mandrel and the ridge bordering the outside of the groove serving as a die. Holes may be provided in the tool for use in restoring roundness to an open end of a pipe.

11 Claims, 4 Drawing Sheets

TOOL FOR RESTORING ROUNDNESS TO PIPE COUPLINGS

BACKGROUND OF THE INVENTION

1. Field of the Invention

The present invention relates to a hand tool for restoring roundness in the ends of a pipe coupling, fitting or piece of pipe formed of a relatively soft metal such as a copper.

2. Brief Description of the Prior Art

Plumbers who install water lines generally employ readily available means for restoring roundness to copper pipe and copper couplings. What this means is that they make do with tools which are not intended for that purpose such as screwdrivers for use as mandrels and the hole in a crescent wrench for use as a die. Insofar as known, there are no special tools in common use for this purpose. Similar problems may be encountered by workmen installing other pipe lines wherein the material selected or the wall thickness render the pipe or the pipe couplings deformable under common handling conditions.

In a joint between a pipe and a coupling, the pipe should be round on its outside surface at the open end, whereas with a pipe coupling it is the inside surface that is important. For this reason, the tools needed to restore roundness in a pipe are generally different from those needed for a coupling.

While neither pipe nor pipe couplings are particularly expensive, a workman's time is costly. Rounding out a pipe or coupling with tools not intended for that purpose or locating another coupling that is not bent is a poor use of a skilled plumber's time. It would therefore be desirable to have a tool for restoring roundness in a coupling that is designed for that purpose, preferably a tool that could be used for restoring roundness in a pipe also. It would further be desirable if the tool was combined with some other tool that a workman needs to carry anyway, like a wrench, pipe cutter, etc.

BRIEF SUMMARY OF THE INVENTION

In view of the above, it is an object of the present invention to provide a tool for restoring roundness to a pipe or coupling, eliminating the difficulties in using tools not designed for that purpose. It is another object to provide a tool for restoring roundness to a pipe or coupling that can be incorporated into another necessary tool, thus eliminating the difficulties associated in carrying a multiplicity of tools. It is also an object to provide a tool permitting the rapid rounding out of a pipe or pipe coupling with a minimum of effort making a more economical installation of water lines or the like possible. Other objects and features of the invention will be in part apparent and in part pointed out hereinafter.

In accordance with the invention, a hand tool for restoring roundness in an open end of a pipe coupling has a body with a series of sections of non-concentric grooves of increasing diameters separated by ridges beginning with a first ridge.

The grooves in the body are adapted to receive a range of different sized pipe couplings, with the groove having the smallest diameter forming an annular space partially bordered on the inside by the first ridge. The first ridge has a length substantially equal to an internal diameter of the open end of the smallest coupling to be rounded, each successive groove of increasing diameter forming an annual space partially bordered on the inside by the first ridge and by a successive ridge. In use, a pipe coupling to be restored to roundness is slipped over and rotated in one of the grooves, any ridge bordering the inside of the groove serving as a mandrel and any ridge bordering the outside of the groove serving as a die.

The invention summarized above comprises the constructions hereinafter described, the scope of the invention being indicated by the subjoined claims.

BRIEF DESCRIPTION OF THE SEVERAL VIEWS OF THE DRAWING

In the accompanying drawings, in which several of various possible embodiments of the invention are illustrated, corresponding reference characters refer to corresponding parts throughout the several views of the drawings in which.

DETAILED DESCRIPTION OF THE INVENTION

Figure 1:
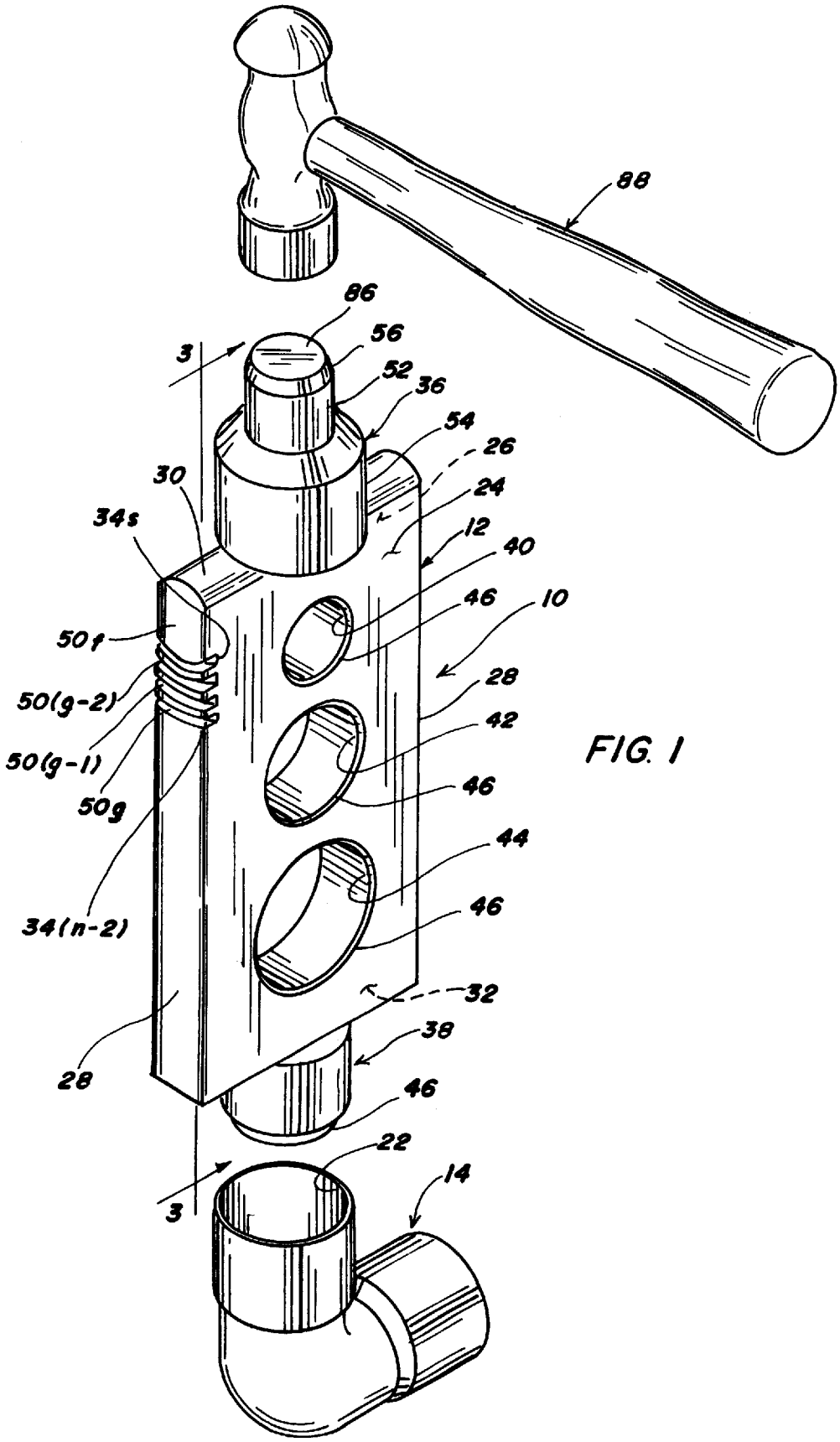
FIG. 1 is a perspective view of a tool in accordance with the present invention, whose function is dedicated to restoring roundness in a pipe or pipe coupling.
Figures 2, 3:
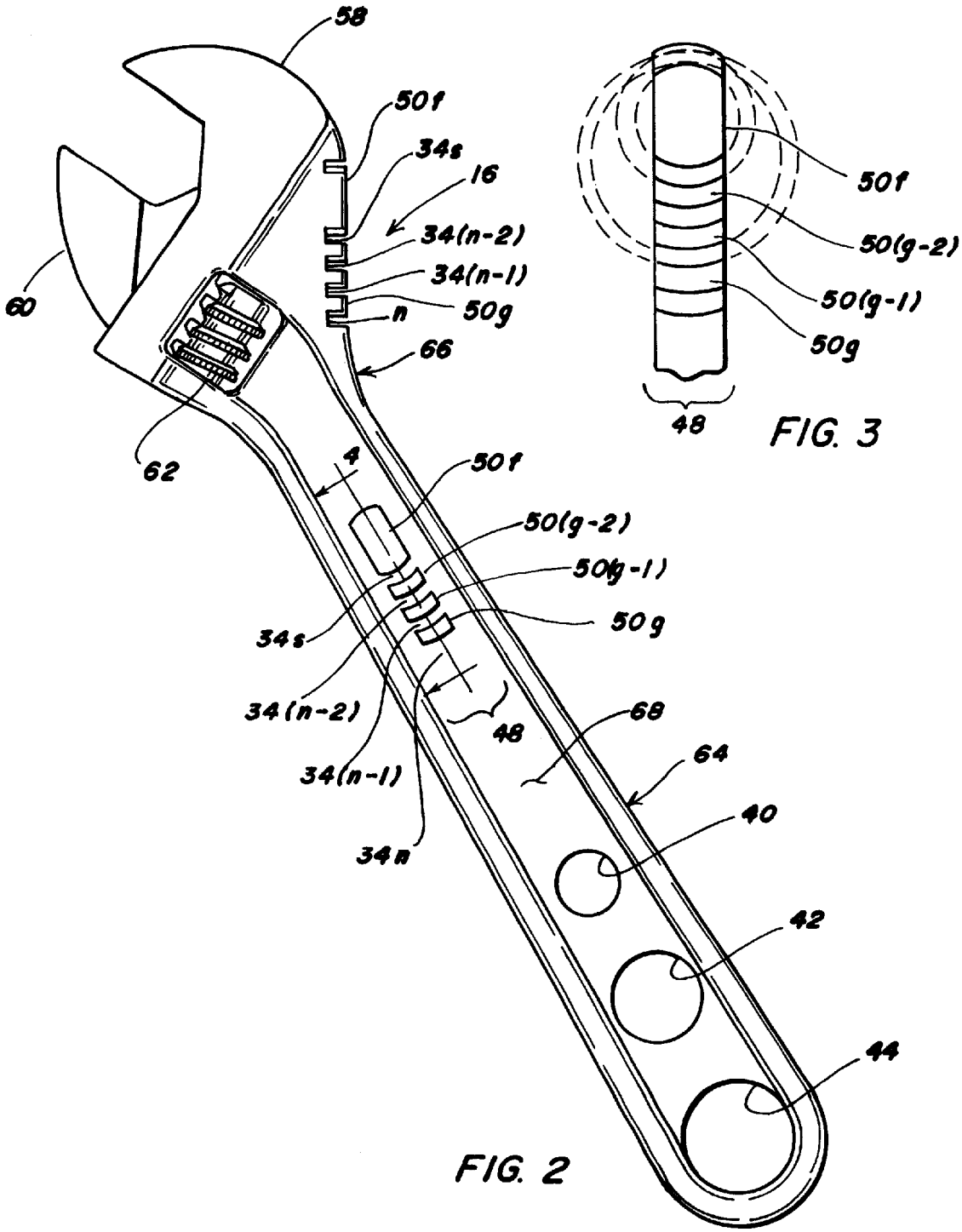
FIG. 2 is a plan view of a tool in accordance with present invention incorporated into a crescent wrench.
FIG. 3 is a detail taken along line 3—3 in FIG. 1 showing a side view of a plurality of grooves for use in rounding out a coupling.
Figure 5:
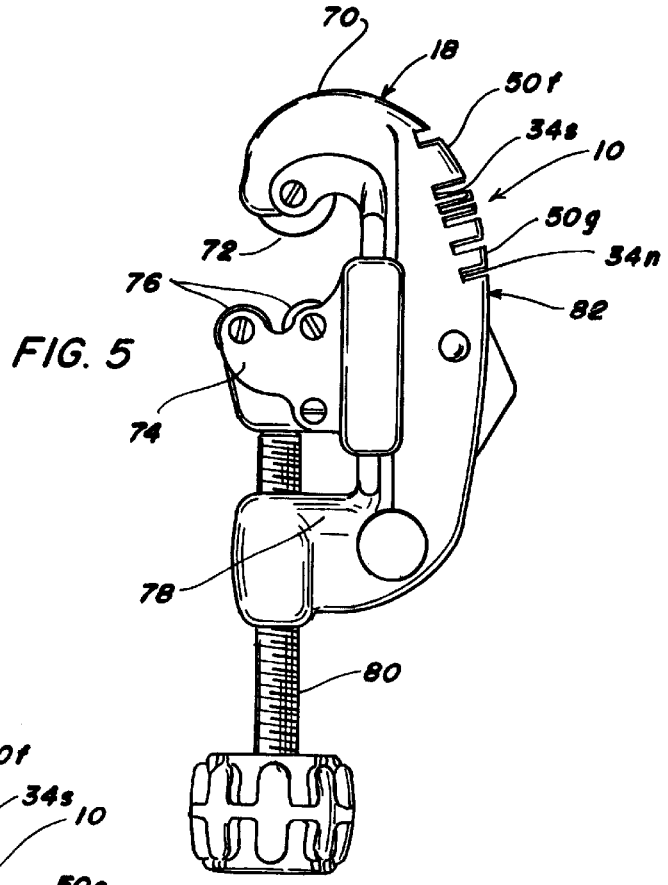
FIG. 5 is a plan view of a tool in accordance with the present invention incorporated into a pipe cutter; and, FIG. 6 is a plan view of a tool in accordance with the present invention incorporated into a tongue-and-groove pliers.
Figure 6:
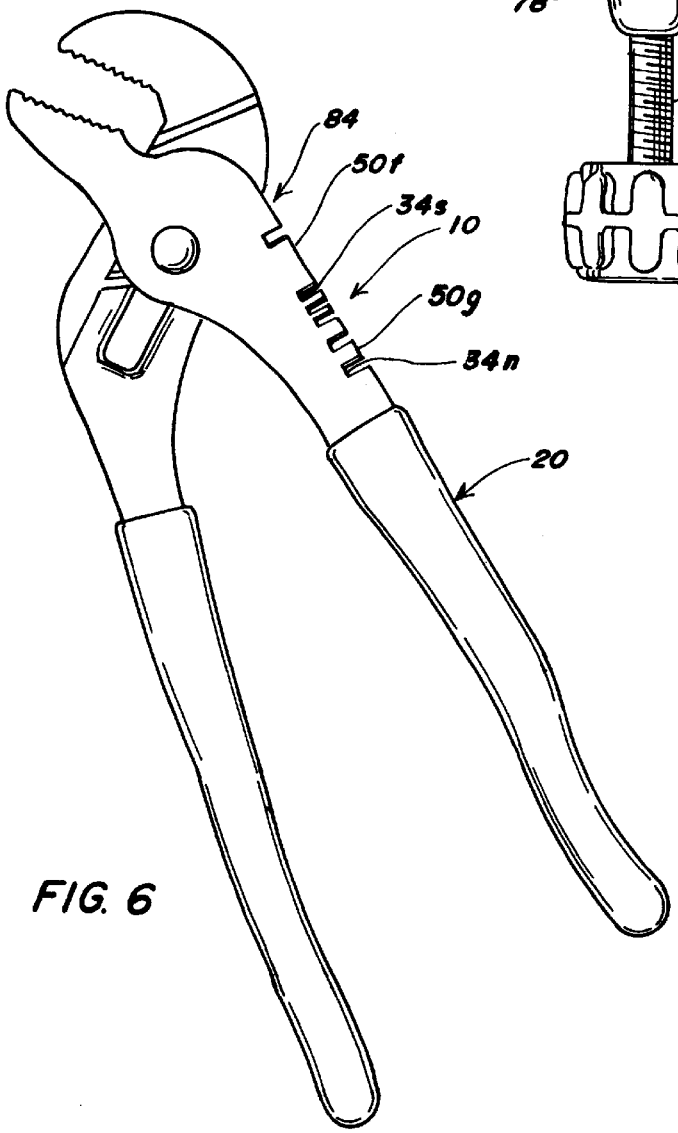

Referring to the drawings more particularly by reference character, reference numeral 10 refers to a hand tool in accordance with the present invention. Tool 10 may be a body 12 dedicated for use to restoring roundness to a pipe coupling, as shown in FIG. 1, and to a pipe. Alternatively, tool 10 may be part of a crescent wrench 16 as shown in FIG. 2, pipe cutter 18 as shown in FIG. 5, tongue-and-groove pliers 20 as shown in FIG. 6 such as sold under the trademark CHANNELLOCK or some other tool that a workman may need to carry anyway.

Figure 4A:
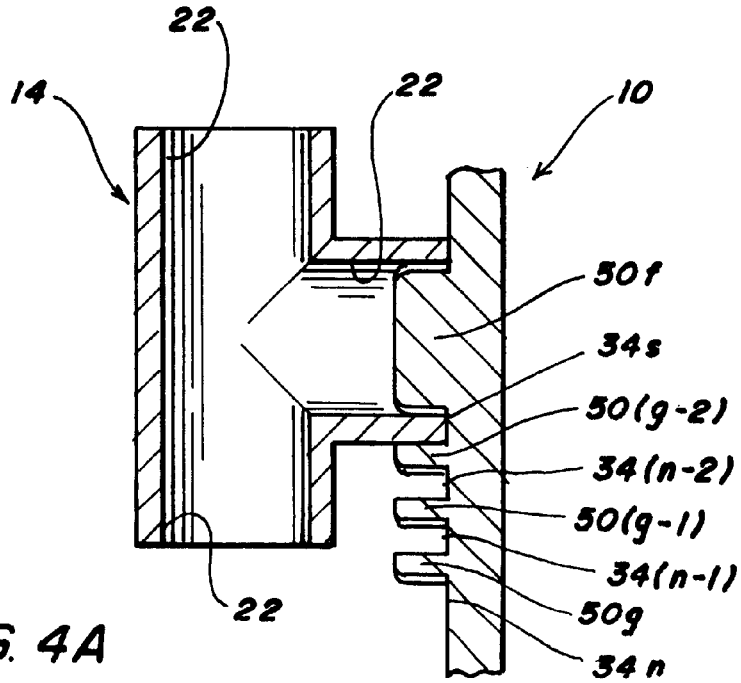
FIG. 4A is a cross-section taken along 4—4 in FIG. 2 showing a t-coupling over the first ridge and in the smallest groove.
Figure 4B:
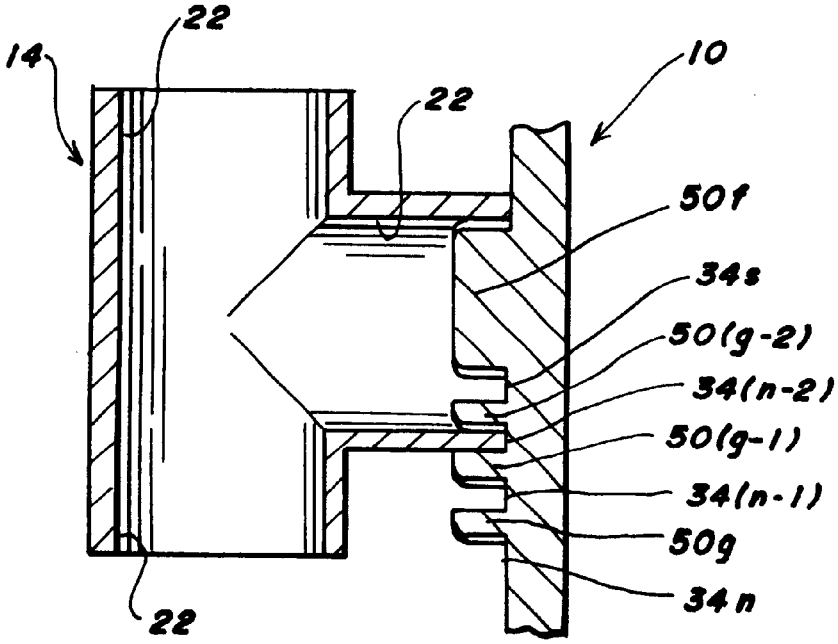
FIG. 4B is a cross-section similar to FIG. 4A showing a larger coupling over the first and second ridges and in the next larger groove.

Tool 10 is for use with couplings 14 and the pipe to which they are fitted formed of soft copper or some other material which because of wall thickness or metal are susceptible to being bent out-of-round in the course of ordinary handling and which can be restored to roundness with the tool. As shown in FIG. 1, coupling 14 is a short collar with open ends 22 to receive the ends of two or more pipes to be joined together. The most common forms of coupling 14 have two arms and are straight or are bent at forty-five degrees, ninety degrees or some other angle. Other common couplings 14 as shown in FIGS. 4A and 4B are T-shaped with three arms for joining three pipes. Tool 10 may be used with other couplings 14 such as lateral couplings, etc., as will be apparent.

There are different methods for sizing pipe and pipe couplings 14. In the case of copper water tubing, for example, commonly used tubing has the following dimensions:

| Nominal size, in | OD, in, types* K, L | ID, in Type K | ID, in Type L | Wall thickness, in Type K | Wall thickness, in Type L |
|---|---|---|---|---|---|
| ⅜ | 0.500 | 0.402 | 0.430 | 0.049 | 0.035 |
| ½ | 0.625 | 0.527 | 0.545 | 0.049 | 0.040 |
| ⅝ | 0.750 | 0.652 | 0.666 | 0.049 | 0.042 |
| ¾ | 0.875 | 0.745 | 0.785 | 0.065 | 0.045 |
| 1 | 1.125 | 0.995 | 1.025 | 0.065 | 0.050 |
| 1 ¼ | 1.375 | 1.245 | 1.265 | 0.065 | 0.055 |
| 1 ½ | 1.625 | 1.481 | 1.505 | 0.072 | 0.060 |
| 2 | 2.125 | 1.959 | 1.985 | 0.083 | 0.070 |
| 2 ½ | 2.625 | 2.435 | 2.465 | 0.095 | 0.080 |
| 3 | 3.125 | 2.907 | 2.945 | 0.109 | 0.090 |
| 3 ½ | 3.625 | 3.385 | 3.425 | 0.120 | 0.100 |
| 4 | 4.125 | 3.857 | 3.905 | 0.134 | 0.110 |
| 5 | 5.125 | 4.805 | 4.875 | 0.160 | 0.125 |
| 6 | 6.125 | 5.741 | 5.845 | 0.192 | 0.140 |
| 8 | 8.125 | 7.583 | 7.725 | 0.271 | 0.200 |
| 10 | 10.125 | 9.449 | 9.625 | 0.338 | 0.250 |
| 12 | 12.125 | 11.315 | 11.565 | 0.405 | 0.280 |

*Type K recommended for underground service and general plumbing. Type L suitable for interior plumbing and other services.
SOURCE: American Brass Co.

The dimensions and nomenclature for pipe couplings 14 with Type K copper tubing, are as follows: For a ½ in. pipe, the pipe coupling has ID of ⅝ (0.625 in.); ¾ in. pipe requires a fitting with a ⅞in. ID; 1 in. pipe uses a fitting with a 1⅛ in. ID and so forth. The OD of the couplings depends on the wall thickness of the coupling and generally increases with the inside diameter. Hence it is seen that in the case of Type K tubing, a so-called ½-inch pipe has an outside diameter of ⅝ inch, whereas a so-called ½-inch coupling has neither a ½ inch inside or outside diameter, the ½-inch designation referring to the inside diameter of the pipe that it fits. Different conventions apply to other pipes and tubing, depending on the industry that the nomenclature arose. It therefore follows that pipe and pipe couplings 14 should be from the same series.

Starting with FIG. 1, body 12 is a parallelepiped with front and rear faces 24, 26, side edges 28 and top and bottom edges 30, 32, respectively. A plurality of grooves 34 are formed in one of side edges 28. Additionally, body 12 may be provided with punches 36, 38 on the top and bottom sides 30, 32, respectively, and with a plurality of holes 40, 42 and 44, opening on front and rear faces 24, 26. Holes 40, 42 and 44 may be countersunk at 46 to facilitate insertion of a pipe for restoring roundness, whereas punches 36, 38 and grooves 34 may be used to round out a coupling 14.

For use in rounding open end 22 of a coupling 14, grooves 34 as best seen in FIGS. 1–3 comprise a series of sections 48 of non-concentric grooves of increasing diameters separated by ridges 50. In a preferred form, grooves 34 are tangential and sections 48 are arranged in a file. The letter "n" identifies the largest groove 34 and "s" identifies the smallest groove 34, with the intermediate grooves identified as 34(*n*-2) and 34(*n*-1). Lesser or greater numbers of grooves 34 may be provided as will become more apparent. Smallest groove 34*s* forms an annular space partially bordered on the inside by a first ridge 50*f*. First ridge 50*f* has a length substantially equal to an internal diameter of open end 22 of the smallest pipe or pipe coupling 14 to be rounded. For use with pipes or couplings 14 with larger diameters, each successive groove 34 of increasing diameter forms an annular space partially bordered on the inside by first ridge 50, identified by the letter "f" and by a successive ridge. The letter "g" identifies the outermost ridge 50, with the intermediate ridges identified as 50(*g*-2) and 50(*g*-1).

As shown in FIG. 1, punch 36 on top edge 30 may have a stepped diameter for restoring roundness to different sized couplings 14. For example, an end step 52 may have a diameter of ⅝ in. for use with a ½ in. Type K pipe fitting and an intermediate step 54 with a diameter of 1⅛in. for use with a 1 in. fitting. Similarly punch 38 on bottom edge 32 may be stepped. It will also be understood that one or both of punches 36 and 38 may be threaded for receipt of a sleeve (not shown) for use with different sized fittings. As illustrated, however, punch 38 is sized for just one coupling such as ⅞ in. for use with a ¾ in. Type K fitting. A leading edge of punches 36, 38 or each step thereof may be tapered at 56 to facilitate insertion into a coupling. With continuing reference to FIG. 1 and Type K tubing, holes 40, 42 and 44 may have an inside diameter of ⅝in., ⅞ in. and 1⅛ in. for use with ½ in., ¾ in. and 1 in. tubing, respectively, those sizes being most commonly used. It will be understood that the foregoing details as to dimensions are illustrative, not limiting, as other dimensions may be required for other pipes and pipe couplings with other dimensions, as will be readily apparent to one skilled in the art.

Referring now to FIG. 2, tool 10 is shown in combination with crescent wrench 16. As is customary, crescent wrench 16 has a fixed and movable jaw 58, 60, respectively, a thumbscrew 62 and a handle 64. Grooves 34 and ridges 50 may be formed along a side edge 66 of crescent wrench 16 or on a flat face 68 of the handle. On side edge 66, ridges 50 are formed between grooves 34, whereas on flat face 68, grooves 34 are formed between ridges 50. It will be understood that grooves 34 and ridges 50 will not usually be formed in both side edge 66 and flat face 68 as they would be redundant, although different sized grooves and ridges might be provided to accommodate differently dimensioned couplings. Holes 40, 42 and 44 may be formed in handle 64 for use in rounding out pipe.

FIGS. 5 and 6 show tool 10 in combination with other tools that a workman may need to have anyway. In FIG. 5, tool 10 is illustrated in combination with pipe cutter 18. Pipe cutter 18 has a body member with a first end wall 70 upon which is mounted a cutting disc 72. A movable jaw 74 with a pair of rollers 76 for supporting a tube which is to be cut is mounted on a second end wall 78. Jaw 74 is movable longitudinally on a threaded member 80 which is threaded through second end wall 78. Grooves 34 and ridges 50 are formed in a side edge 82 of body member. As shown in FIG. 6, grooves 34 and ridges 50 may also be formed in a side edge 84 of tonque-andgroove pliers 20.

In use, tool 10 as shown in FIG. 1 may be used to round out pipe and pipe couplings 14. Pipe may be rounded by selecting an appropriate one of holes 40, 42 or 44, the selected hole functioning as a die. If coupling 14 is severely deformed, an appropriately sized one of punches 36, 38 may be used. The opposite one of punches 36, 38 being flattened at 86 such that body 12 may be struck with a hammer 88, driving the selected punch into the coupling. Coupling 14 may then be further rounded with grooves 34 and ridges 50.

As shown in FIGS. 4A and 4B, open end 22 of coupling 14 is seated in one of grooves 34. When coupling 14 is a ½ in. Type K fitting, ridge 50*f* is ⅝ in. in length and the distance between first ridge 50*f* and the next successive ridge 50(*g*-2) must be sufficient to accommodate the wall thickness of the coupling and is preferably nominally the same. As coupling 14 is rotated about ridge 50*f*, the inside of open end 22 is rounded for receipt of a pipe, ridge 50*f* serving as a mandrel and ridge 50(*g*-2) as a die. Turning to FIG. 4B, when coupling is a ¾ in. Type K fitting, open end 22 is fitted over ridge 50*f* and ridge 50(*g*-2), the combined length, including groove 34*s* being ⅞ in. As will be apparent, grooves 34 of increasing diameters are used with larger couplings 14.

In view of the above, it will be seen that the several objects of the invention are achieved and other advantageous results attained. As various changes could be made in the above constructions without departing from the scope of the invention, it is intended that all matter contained in the above description or shown in the accompanying drawings shall be interpreted as illustrative and not in a limiting sense.

What is claimed:

1. A hand tool for restoring roundness in an open end of a pipe coupling, said tool having a body with a series of sections of non-concentric grooves of increasing diameters separated by ridges beginning with a first ridge, said grooves adapted to receive a range of different sized pipes, said groove with the smallest diameter forming an annular space partially bordered on the inside by the first ridge, said first ridge having a length substantially equal to an internal diameter of the open end of the smallest pipe coupling to be rounded, each successive groove of increasing diameter forming an annual space partially bordered on the inside by the first ridge and by a successive ridge, whereby a pipe coupling is restored to roundness when the open end is slipped over and rotated in one of the grooves, any ridge bordering the inside of the groove serving as a mandrel.

2. The hand tool of claim 1 wherein the body is a parallelepiped with front and rear faces, side edges and a top and bottom edge, said grooves being in one of the side edges.

3. The hand tool of claim 1 wherein a punch is provided on the top edge and the bottom edge, said punches having different outside diameters for use in restoring a pipe coupling to roundness.

4. The hand tool of claim 3 wherein one or both of the punches is stepped in diameter.

5. A hand tool for restoring roundness to an open end of a pipe coupling, said tool having a body with a series of sections of non-concentric grooves of increasing diameters separated by ridges beginning with a first ridge, said grooves adapted to receive a range of different sized couplings, said groove with the smallest diameter forming an annular space partially bordered on the inside by the first ridge and on the outside by a successive ridge, said first ridge having a length substantially equal to an internal diameter of the open end of the smallest pipe coupling to be rounded, each successive groove of increasing diameter forming an annual space bordered on the inside by the first ridge and by the previous successive ridge and on the outside by a next successive ridge, whereby a coupling is restored to roundness when the open end is slipped over and rotated in one of the grooves, any ridge bordering the inside of the groove serving as a mandrel and the ridge bordering the outside of the groove serving as a die.

6. The hand tool of claim 5 having one or more holes through the body for use in restoring pipe to roundness.

7. A hand tool for restoring roundness to an open end of a pipe coupling, said tool having a body with a series of sections of circular non-concentric grooves of increasing diameters separated by ridges beginning with a first ridge, said grooves adapted to receive a range of different sized couplings, said groove with the smallest diameter forming an annular space partially bordered on the inside by the first ridge and on the outside by a next successive ridge, said first ridge having a length substantially equal to an internal diameter of the open end of the smallest pipe coupling to be rounded, each successive groove of increasing diameter forming an annual space bordered on the inside by the first ridge and by the previous successive ridge and on the outside by the next successive ridge, said series of sections of grooves being in a file, whereby a coupling is restored to roundness when the open end is slipped over and rotated in one of the grooves, any ridge bordering the inside of the groove serving as a mandrel and the ridge bordering the outside of the groove serving as a die.

8. The hand tool of claim 7 wherein the hand tool is a crescent wrench.

9. The hand tool of claim 8 having one or more holes through a handle of the crescent wrench for use in restoring pipe to roundness.

10. The hand tool of claim 7 wherein the hand tool is a pipe cutter.

11. The hand tool of claim 7 wherein the hand tool is a tongue-and-groove pliers.

* * * * *